US007017709B1

(12) United States Patent
Laymance

(10) Patent No.: US 7,017,709 B1
(45) Date of Patent: Mar. 28, 2006

(54) MARINE SAFETY LADDER APPARATUS

(76) Inventor: Raymond N. Laymance, 1120 SE. 46th St., Cape Coral, FL (US) 33904

( * ) Notice: Subject to any disclaimer, the term of this patent is extended or adjusted under 35 U.S.C. 154(b) by 45 days.

(21) Appl. No.: 10/771,857

(22) Filed: Feb. 3, 2004

Related U.S. Application Data

(60) Provisional application No. 60/444,572, filed on Feb. 3, 2003.

(51) Int. Cl.
*E04G 3/00* (2006.01)
*E06C 9/00* (2006.01)
*B63B 17/00* (2006.01)

(52) U.S. Cl. ..... 182/97; 182/93; 182/82; 114/362

(58) Field of Classification Search ..... 182/97, 182/93, 91, 92, 194, 127, 1, 88; 114/362, 114/366, 219; 52/182, 183
See application file for complete search history.

(56) References Cited

U.S. PATENT DOCUMENTS

| | | | | |
|---|---|---|---|---|
| 3,731,761 | A * | 5/1973 | Glenn | 182/97 |
| 3,970,169 | A * | 7/1976 | Hernandez Gonzalez | 182/1 |
| 4,067,412 | A * | 1/1978 | Jackson | 182/93 |
| 4,724,925 | A * | 2/1988 | Ritten | 182/97 |
| 4,971,168 | A * | 11/1990 | Stanescu | 182/1 |
| 5,152,245 | A * | 10/1992 | Olsen | 114/362 |
| 5,887,540 | A * | 3/1999 | Krish, Jr. | 114/362 |
| 5,950,267 | A * | 9/1999 | Ricci, Jr. | 182/97 |
| 6,598,562 | B1 * | 7/2003 | Dutkiewicz et al. | 182/93 |

* cited by examiner

*Primary Examiner*—Hugh B. Thompson, II

(57) ABSTRACT

A buoyant marine safety ladder apparatus includes a ladder that is pivotably mounted to a seawall or other support platform and is alternatable between a retracted condition, wherein the ladder is floating above the water, and a deployed or extended condition, wherein the lower end of the ladder extends into the water. A stop component restricts pivoting of the ladder such that it extends upwardly from the body of water at an angle of approximately 45° when in the extended condition.

15 Claims, 9 Drawing Sheets

MARINE SAFETY LADDER APPARATUS

RELATED APPLICATION

This application claims the benefit of U.S. Provisional Application Ser. No. 60/444,572, filed Feb. 3, 2003.

FIELD OF THE INVENTION

This invention relates to a marine safety ladder apparatus and, more particularly, a buoyant ladder that is mounted pivotably to a seawall, pier or the like for alternating between a retracted condition, wherein the ladder floats on a body of water, and a deployed condition wherein the ladder extends into the water at an angle that permits the steps of the ladder to be conveniently ascended.

BACKGROUND OF THE INVENTION

Seawalls, piers, docks and similar structures are commonly located adjacent to a body of water, such as an ocean, lake, river or canal. Currently, various types of vertically mounted marine ladders used to provide boaters, swimmers and others access into and out of the water. Such ladders can also serve as a safety feature for persons who have accidentally fallen into the water. Vertically mounted ladders are likewise widely employed on boats and watercraft.

Standard marine ladders commonly exhibit a number of problems. Despite tidal changes, the ladder usually remains at least partly submerged much, if not most, of the time. The harsh marine environment can cause rapid deterioration and failure of the ladder. In addition, over time, barnacles and other types of marine debris tend to collect on the ladder. Barnacles can cut and injure persons climbing the ladder. Algae, seaweed and similar debris cause the ladder to be extremely slippery and dangerous.

Climbing a conventional vertically mounted marine ladder also tends to require significant upper body strength and agility. Young children, older persons and persons with physical disabilities can experience particular difficulty pulling themselves out of the water and climbing onto a seawall, boat or other structure.

Known marine ladders exhibit particular disadvantages when used in safety, rescue and/or emergency situations. For example, a non-swimmer or poor swimmer (such as a young child or elderly or disabled person) who accidentally falls into the water near a dock, pier, seawall, boat or similar structure, may become exhausted from thrashing about in the water. Such persons may lack the strength required to climb a vertical safety ladder. By the same token, in most cases, it is virtually impossible for a dog or other type of animal that has fallen in the water to successfully pull itself out using the known marine safety ladders. Ascending such ladders is not only frequently arduous for humans and animals alike, it may also pose a life-threatening situation.

Various types of floating ladders are currently known. Nonetheless, these ladders are invariably intended to be mounted and climbed in an upright or vertical manner. Virtually no known ladders are available which enable a human or an animal to exit a body of water on a series of steps arranged at an angle resembling that of a flight of stairs. I have recognized that such a structure would be far easier to climb than a conventional marine ladder and would overcome many, if not most, of the problems exhibited by the prior art.

SUMMARY OF THE INVENTION

It is therefore an object of the present invention to provide an improved marine safety ladder that is arranged to extend upwardly from a body of water at a convenient non-vertical angle so that it is much less strenuous and far more convenient for a person using the ladder to climb out of the water and onto an adjacent structure.

It is a further object of this invention to provide a marine safety ladder that is readily accessible and convenient to use for climbing onto a seawall, pier, dock, boat, raft or similar structure.

It is a further object of this invention to provide a marine safety ladder that avoids collecting barnacles, seaweed and other underwater debris and which, therefore, is much safer to climb than conventional marine ladders.

It is a further object of this invention to provide a durable, long-lasting marine safety ladder constructed from a buoyant, high-strength material, which effectively resists underwater corrosion and premature deterioration.

It is a further object of this invention to provide a marine safety ladder that provides significant life saving and safety benefits.

It is a further object of this invention to provide a marine safety ladder that may be easily accessed and used by both people and animals.

It is a further object of this invention to provide a marine safety ladder that allows a person to conveniently climb the ladder in a manner similar to climbing a flight of stairs, which does not require that the person have significant upper body strength and/or agility and which may be used successfully by small children, as well as older and disabled persons.

It is a further object of this invention to provide a marine safety ladder that is quickly and conveniently alternated between retracted and deployed conditions.

It is a further object of this invention to provide a marine safety ladder that represents a significant safety improvement over existing marine ladders.

This invention results from a realization that an improved marine safety ladder may be achieved by mounting the ladder to a structure extending above the water such that the ladder is pivotally extendable into the water when it is held at a non-vertical angle of about 45° relative to the water. This allows the ladder to be conveniently ascended with little or no effort. Buoyantly supporting the ladder above the water, when the ladder is not in use, also enables the ladder to avoid collecting debris and prolongs the life of the product.

This invention features a buoyant marine safety ladder apparatus including a support bracket attached to a platform structure located adjacent to and generally above a body of water. The platform structure may comprise a seawall, pier, dock, boat or virtually any other type of structure onto which a person or animal may need to climb from the body of water. The ladder includes a pair of elongate side rails that are pivotably mounted to the support bracket proximate upper ends of the respective rails. A series of transverse steps extend between and interconnect the side rails to define a ladder. The ladder is buoyant and pivotably alternatable between a raised or retracted condition and a lowered or extended condition. When the water level is above a threshold level and less than a predetermined external downward force is applied to a lower portion of the ladder, the ladder floats above the water in the retracted condition. Alternatively, if either the water level drops below the threshold level or the predetermined downward force is applied to the lower portion of the ladder, the ladder pivots downwardly relative to the support platform and into the extended condition. When the predetermined external downward force (typically in excess of 2–3 pounds) is applied to the ladder and the water level is above the threshold level, the lower portion of the ladder is submerged beneath the surface of the water. A stop component is attached to the support bracket for limiting downward pivoting movement of the ladder into the extended condition such that the ladder extends into and upwardly from the water at a non-vertical angle.

In a preferred embodiment, the steps are oriented between the side rails such that an upper surface of each step is held substantially horizontally when the ladder is supported in the extended condition. The ladder preferably forms an angle of approximately 45° with the surface of the water in the extended condition. Typically, when the ladder is in the retracted condition, it floats above and maintains an angle of approximately 0° with the upper surface of the water.

A mounting bracket may be secured to the support platform for pivotably supporting the ladder. The mounting bracket may be releasably attached to the cap of a seawall or other support platform by means of locking bolts or otherwise. The support bracket may carry an upper pivot shaft, to which the side rails of the ladder are pivotably mounted. A lower shaft or bar may also be attached and extend outwardly from the mounting bracket for limiting downward pivoting of the ladder. The upper and lower shafts of the mounting bracket, as well as the side rails of the ladder are constructed such that the side rails extend downwardly into the water at an angle of approximately 45° relative to the surface of the water when the ladder is in the extended condition and the lower shaft is limiting further downward movement of the ladder. The side rails may include aligned slots or openings proximate the respective upper ends of the rails for receiving the upper pivot shaft such that the rails and, thereby the ladder, are pivotable about the upper shaft. The lower shaft is typically engaged by respective lower edges of the side rails when the ladder is in the extended condition.

A float element may be secured to and extend between the side rails proximate a lower end of the ladder to provide the ladder with the required buoyancy. Alternatively, the side rails and/or steps of the ladder may comprise an integrally buoyant material, which enables the ladder to float in accordance with this invention.

The side rails may include slots or other means that define a handrail for assisting a person in ascending the steps when the ladder is in the extended condition. By the same token, a handrail may be secured to and extend upwardly from the mounting bracket.

The bracket may orient the ladder such that it extends generally parallel to the outer edge of the platform structure. Alternatively, the ladder may be oriented perpendicularly or otherwise transversely to the edge of the platform structure.

DETAILED DESCRIPTION OF PREFERRED EMBODIMENTS

Other objects, features and advantages will occur from the following description of a preferred embodiment and the accompanying drawings, in which:

FIG. 11 discloses the ladder in a lowered condition and FIG. 12 shows the ladder fully raised.

Figure 1:
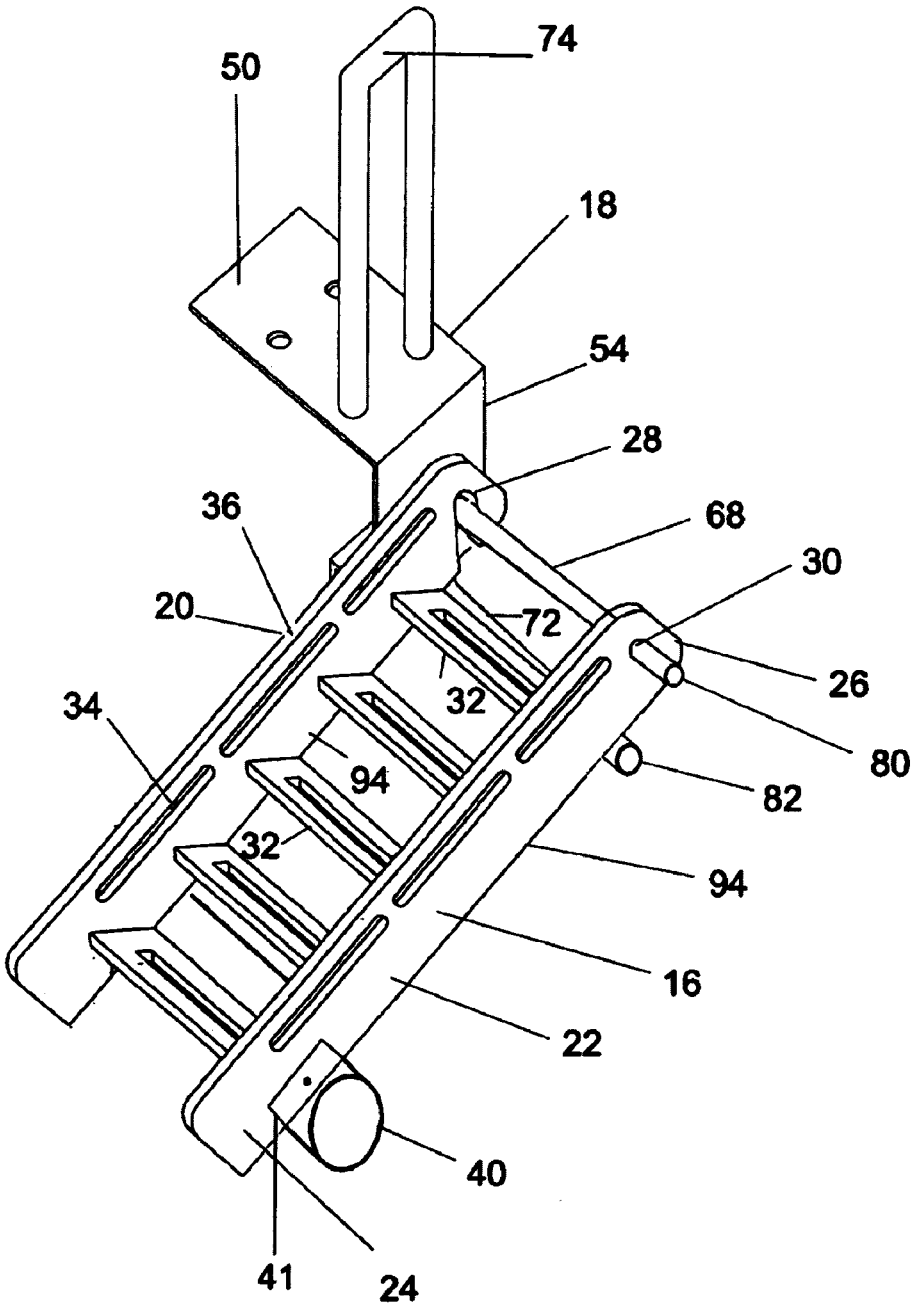
FIG. 1 is a perspective view of a buoyant marine safety ladder pivotably mounted to a seawall and extending downwardly into an adjacent body of water.

There is shown in FIG. 1 a buoyant marine safety ladder apparatus 10 that is pivotably mounted to a seawall 12 and, more particularly, to the cap 14 of the seawall. The seawall is constructed adjacent to a body of water W, which may comprise an ocean, lake, pond, canal, pool or virtually any other body of water or waterway. It should also be understood that the use of apparatus 10 is not limited to a seawall. The marine safety ladder of this invention may also be mounted to and used in connection with all sorts of docks, piers, pool decks and other platform structures mounted adjacent to or in a body of water. The ladder may likewise be employed on structures that float or are otherwise positioned within the water. These include boats, rafts and other marine structures (e.g. oil rigs, etc.). The particular type of platform structure is not a limitation of this invention. What is critical is the construction of the buoyant, pivoting marine safety ladder apparatus, which enables a person to conveniently and safely climb from the water (or alternatively from a vessel floating in the water) onto the platform structure.

Figure 2:
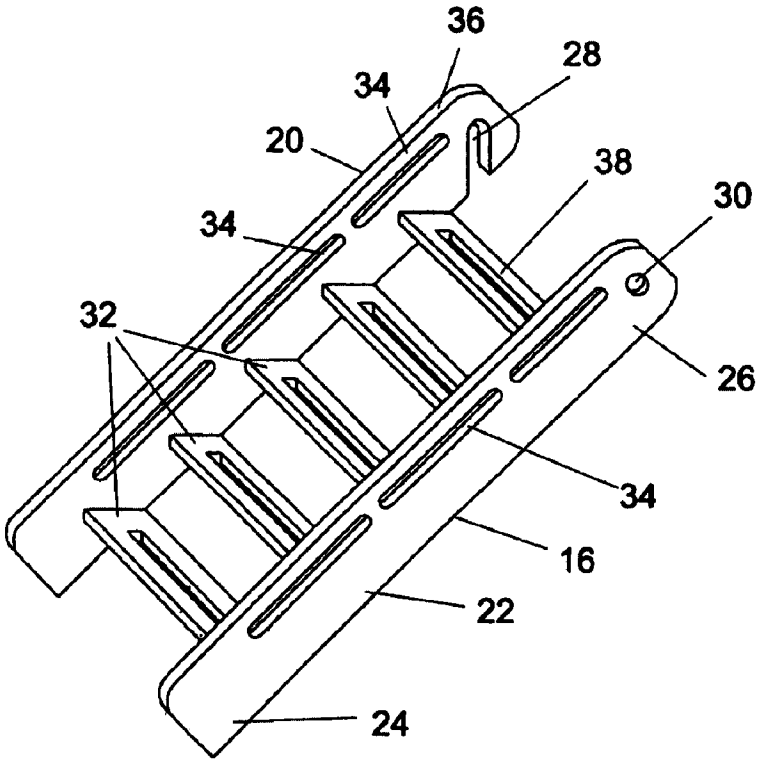
FIG. 2 is a perspective view of the ladder by itself.
Figure 3:
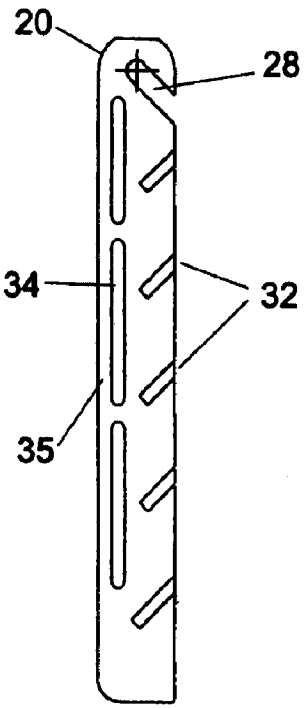
FIG. 3 is an elevational side view of one of the side rails.
Figure 4:
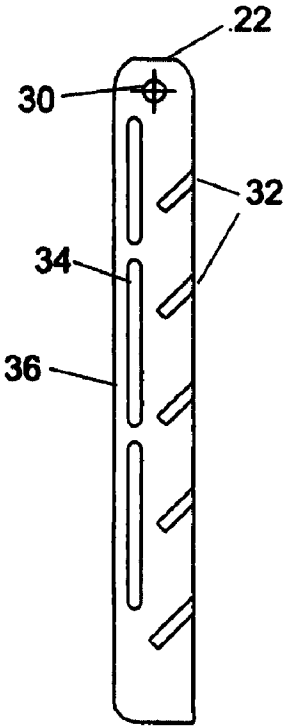
FIG. 4 is an elevational side view of the other side rail.

More particularly, apparatus 10 includes a ladder 16 that is mounted to the platform structure (seawall 12) by means of a mounting bracket 18. Ladder 16, which is shown alone in FIG. 2, includes a parallel pair of elongate side rails 20 and 22 that extend beside the seawall from a lower end portion 24 to an upper end portion 26. Interior side rail 20 (shown alone in FIG. 3) includes a recess or slot 28 formed proximate the upper end thereof. Outer side rail 22 (shown alone in FIG. 4) includes a hole or opening 30 that is substantially aligned with recess 28. The aligned recess and hole enable ladder 16 to be pivotably mounted onto the mounting bracket in a manner that will be described more fully below. It should be understood that, in alternative embodiments, side rail 20 may include a circular hole and/or side rail 22 may include a recess.

A plurality of steps 32, FIGS. 1–4, extend transversely or laterally between side rails 20 and 22. The steps are interconnected to each of the side rails such that ladder 16 is defined. Various means may be used to attach the steps to the side rails. For example, pairs of complementary aligned, angled slots may be formed on the inner surfaces of the side rails for receiving respective ends of each step. Various types of screws, bolts, adhesives or other fasteners may be employed to securely join the steps to the side rails.

Side rails 20 and 22 and steps 32 of ladder 16 are preferably composed of a lightweight, corrosion-resistant synthetic material such as plastic lumber. Nonetheless, such material is not a limitation of this invention. Various metals, metal alloys and other types of plastic may be utilized. A material that resists corrosion from saltwater and other types of marine environments is preferred. It is also preferred that the material comprising the ladder resist the collection of barnacles, algae, seaweed and other types of marine debris. The side rails 20 and 22 may include elongate, longitudinally aligned slots 34 that effectively form handrails 36 on each of the side rails. In certain embodiments, the slots may be eliminated. Other frictional gripping components may be employed. Steps 32 may also include longitudinal slots or voids 38 that reduce the amount of material required for the steps and thereby reduce the weight of the ladder. The steps may have flat or convexly curved upper surfaces.

A cylindrical float 40, FIG. 1, is secured to a lower edge of ladder 16 proximate lower end portion 24. More particularly, float 40 comprises a cylindrical PVC element having end caps secured thereto. The interior of the cylinder contains only air such that the float is buoyant within water W. Float 40 may be attached to ladder 16 by various known means of attachment such as straps, bolts, screws, rivets, adhesives, etc. In the version shown in FIG. 1, a pair of 90° angle brackets 41 (only one of which is shown) are fastened by screws to the float and respective side rails. The cylindrical float typically extends between side rails 20 and 22 and may also be attached to an inner edge of at least one of the steps 32. In alternative embodiments, the material comprising the ladder is itself integrally buoyant and no externally mounted float is used. Nonetheless, a cylindrical float 40 is particularly preferred because when the ladder is in the retracted condition, described below, it is supported fully above (and not partially submerged in) the water so that it resists collecting barnacles, algae, seaweed and other marine debris.

Figure 5:
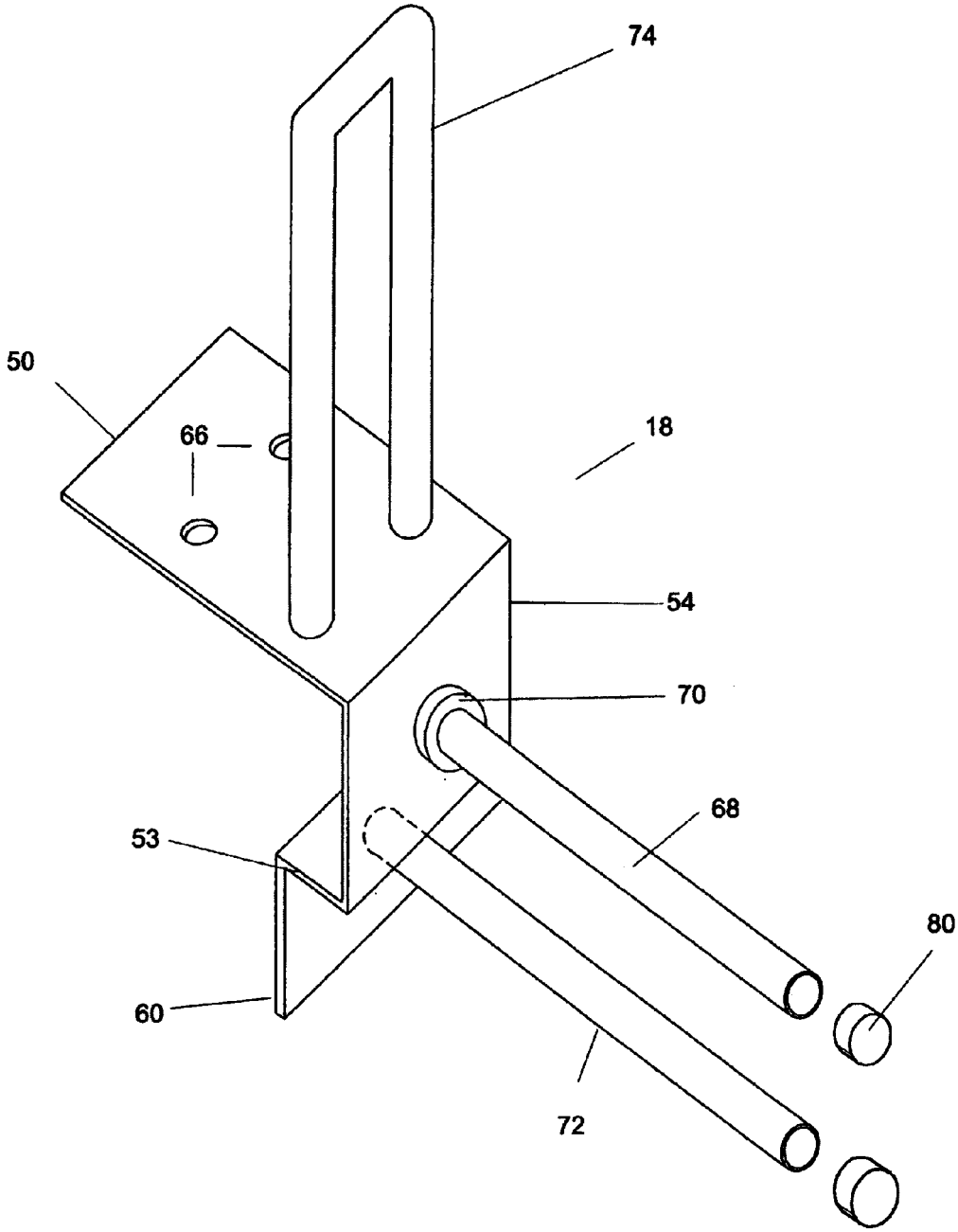
FIG. 5 is a perspective view of the seawall mounting bracket.
Figure 6:
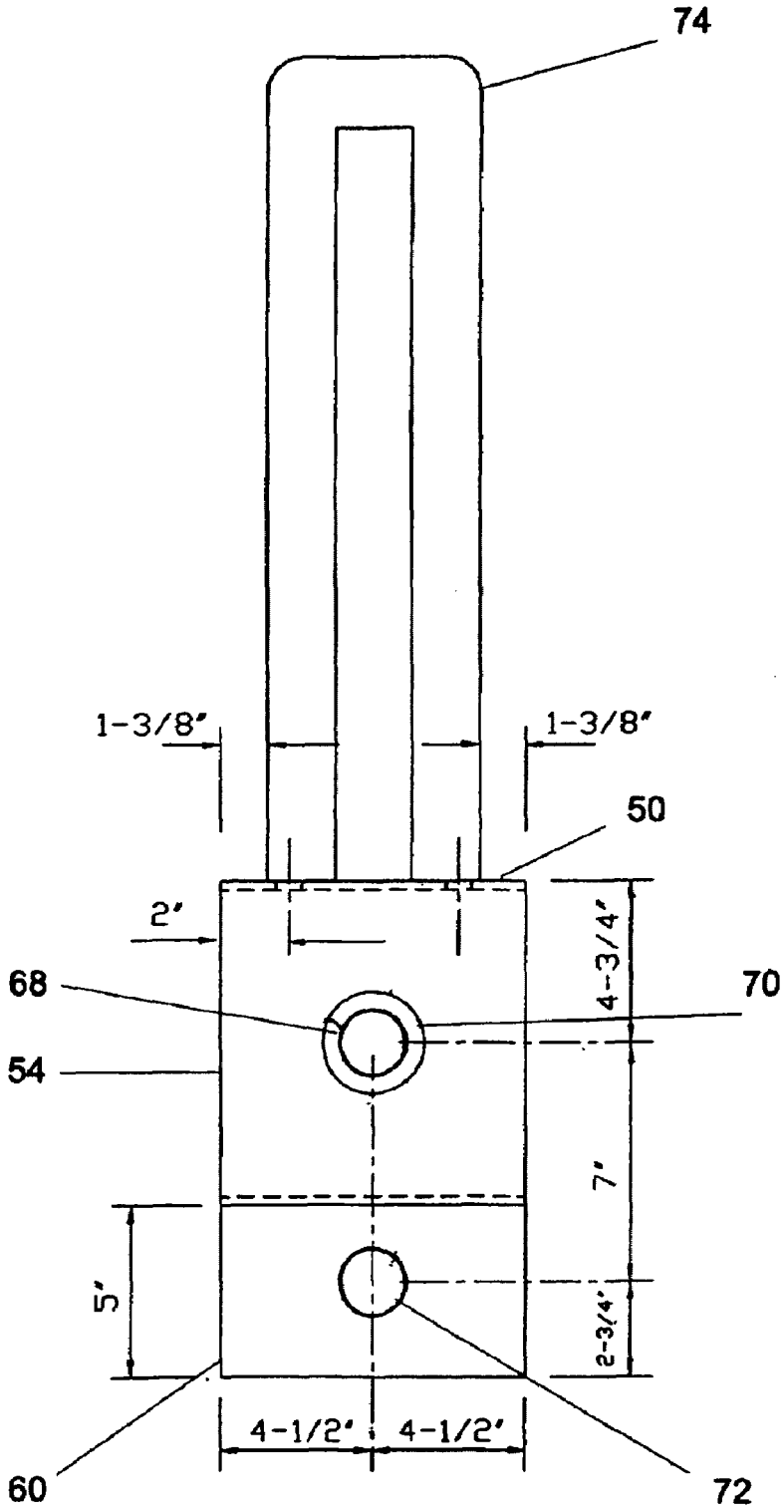
FIG. 6 is an elevational, front view of the mounting bracket.
Figure 7:
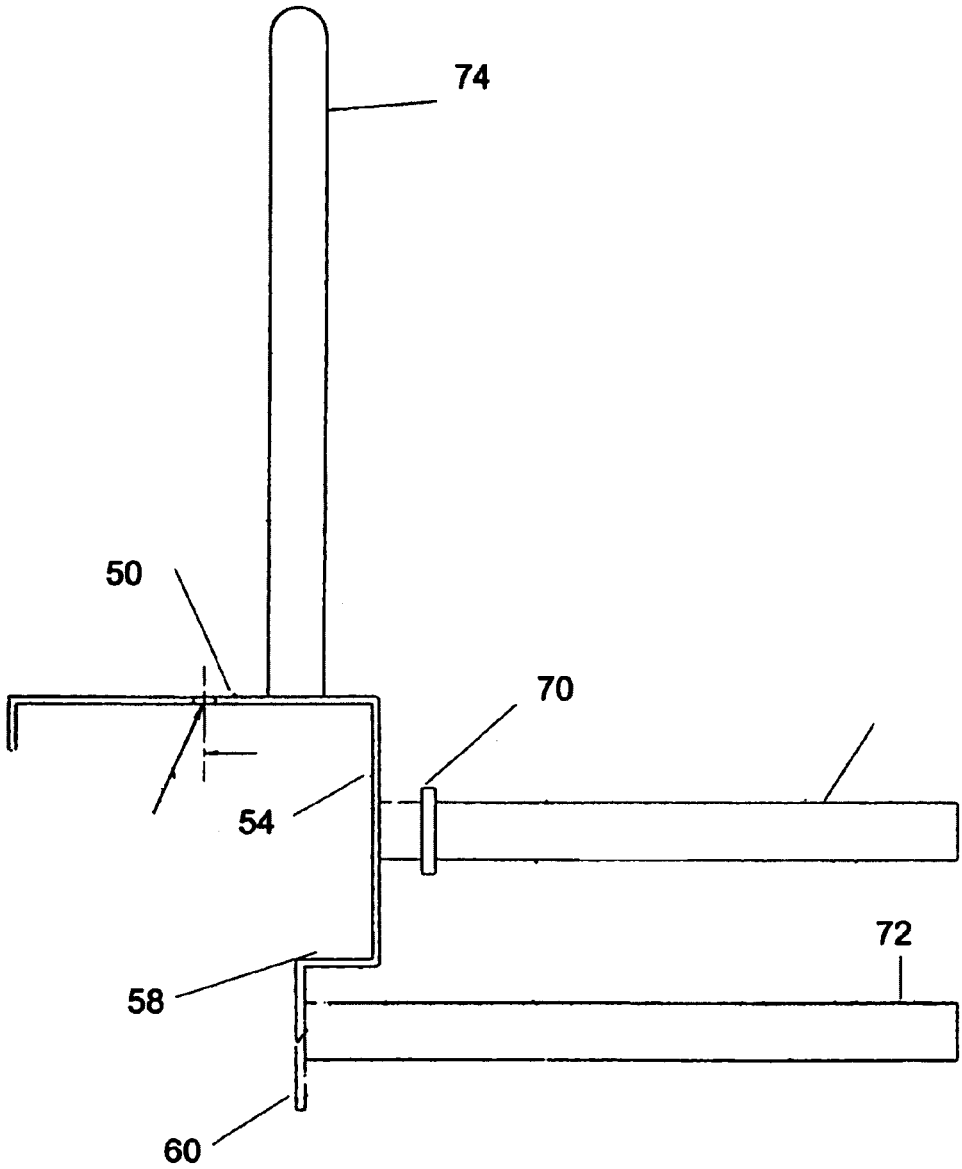
FIG. 7 is an elevational, side view of the mounting bracket.

Mounting bracket 18, shown alone in FIGS. 5–7, includes a generally flat upper plate 50 that engages the upper surface 52 of seawall cap 14. A substantially flat second plate 54 is attached unitarily to plate 50 and extends downwardly therefrom at a 90° angle such that plate 54 flushly engages the front surface 56 of seawall cap 14. An inwardly turned lower horizontal plate portion 58, FIGS. 5–7, is unitarily connected and engagable with the bottom lip of seawall cap 14. Finally, a depending plate 60 is attached unitarily to plate section 58 and depends therefrom at a perpendicular angle for flushly interengaging the vertical surface 64, FIG. 1, of seawall 12. Bracket 18 is secured to the seawall or other platform structure by means such as bolts, not shown, which are interengaged with upper plate 50 through complementary holes 66, FIG. 5. These bolts pass through the holes and interengage the upper surface 52 of seawall cap 14. It should be understood that in alternative embodiments, the mounting brackets may have a wide variety of other types of shapes and configurations. Other means may be employed for securing the mounting brackets to the particular type of platform structure (e.g. seawall, piling, pier, marine vessel) that is involved. Typically, the plate portions of the mounting bracket comprise steel or other durable material able to withstand harsh marine conditions.

An upper pivot shaft 68, which preferably comprises a piece of steel pipe or a similar component, is permanently secured to and extends horizontally outwardly from plate 54. As best shown in FIGS. 5–7, an annular collar 70 may be mounted on shaft 68 and spaced a short distance apart from plate 54. It should be understood that the dimensions shown in FIGS. 6 and 7 are examples only and do not constitute a limitation of this invention. Various other dimensions may be used within the scope of the invention.

A second, lower stop shaft 72 is similarly secured to and extends horizontally outwardly from depending plate 60. As best shown in FIG. 6, shaft 72 is positioned directly beneath shaft 68. Once again, the shaft may comprise a steel pipe or similar component that is welded or otherwise permanently secured to plate 60.

A handle 74, FIGS. 1, 5–7, is permanently attached to the upper surface of plate 50. Handle 74 typically has an inverted U-shaped configuration and comprises stainless steel pipe or similar material. It may be welded, screwed or otherwise permanently fastened to the upper surface plate 50.

As stated above, alternative mounting bracket structures may be employed. In particular, the plate construction shown herein may be altered to fit another type of platform structure (e.g. wall, dock, vessel, etc.). The upper pivoting shaft and lower stop shaft, whose functions are described more fully below, may be mounted to other types of structures and arranged to extend either perpendicularly from or parallel to the platform structure so that the ladder can pivot between retracted and extended conditions.

Figure 8:
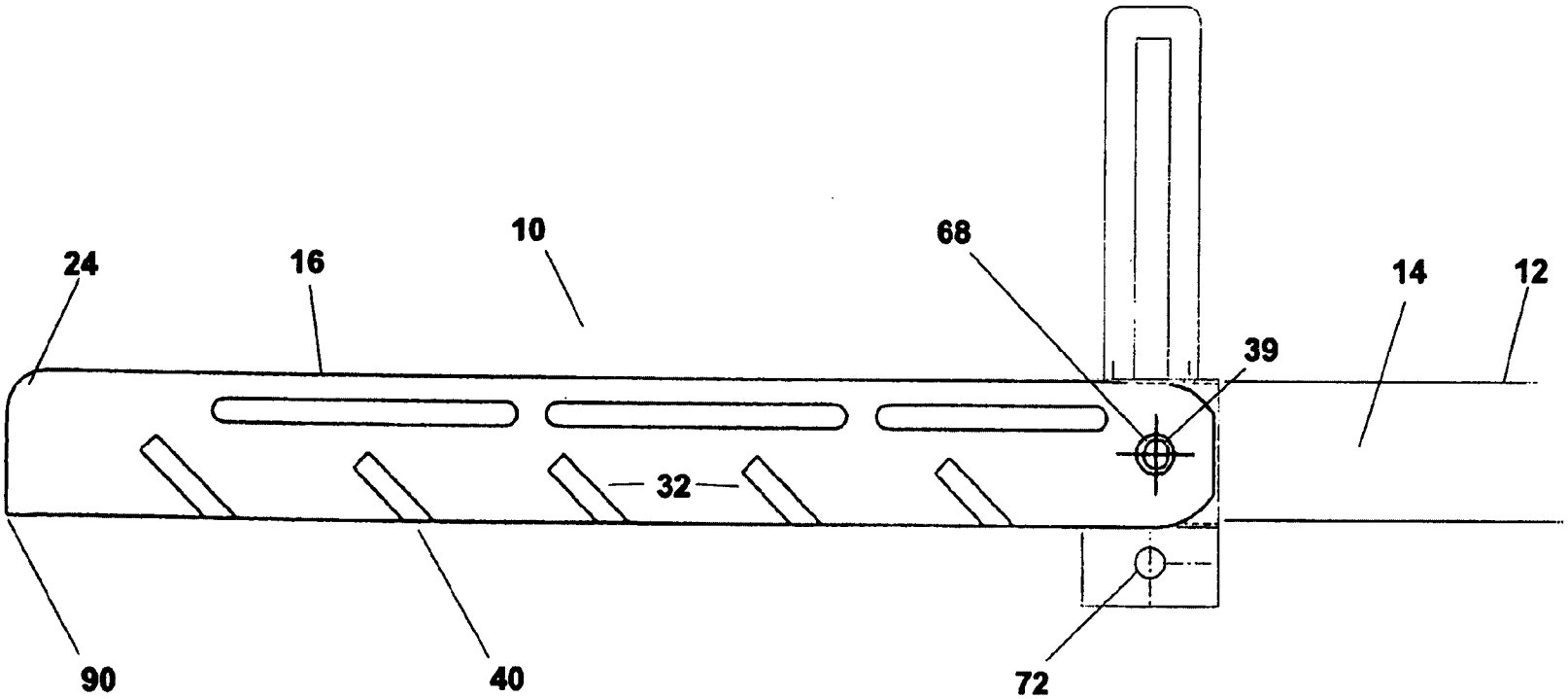
FIG. 8 is an elevational, side view of the marine safety ladder in a retracted condition wherein the ladder is floating generally horizontally above a body of water.
Figure 9:
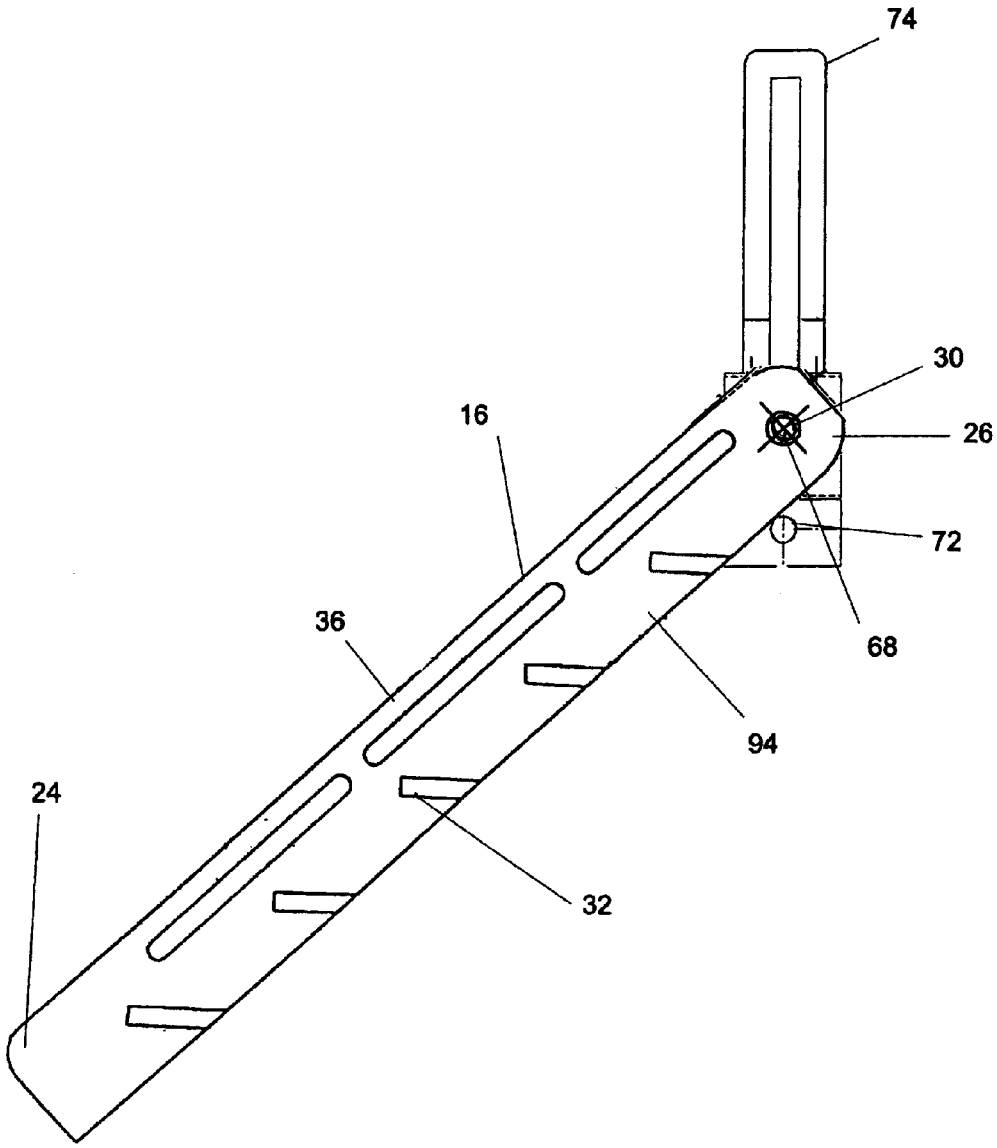
FIG. 9 is a view similar to FIG. 8 with the ladder in an extended position wherein the ladder forms an angle of approximately 45° with the water so that ascending the ladder onto an adjacent seawall is facilitated considerably.

The fully assembled safety ladder apparatus 10 is depicted in FIGS. 1, 8 and 9. Bracket 18 is secured to seawall 12 such that upper and lower shafts 68 and 72 extend horizontally outwardly from the seawall and above water W. Ladder 16 is mounted quickly and conveniently onto the bracket in a pivotable manner. Specifically, recess 28 and aligned hole 30 are interengaged with upper pivot shaft 68. Recess 28 allows rail 20 to be initially slipped over shaft 68 without having to perform any precise alignment. The ladder may then be slid inwardly toward the seawall such that the distal end of shaft 68 is inserted through hole 30 in outer side rail 22. The inner side rail 20 is positioned on shaft 68 between plate 54 and collar 70. This holds the ladder in place and prevents it from accidentally slipping longitudinally off of the shaft. After the ladder is mounted in the foregoing manner, a plastic or rubber cap 80, FIGS. 1 and 5, may be mounted to the outer end of shaft 68. A similar cap is likewise supplied to the distal end of shaft 72. As previously explained, in alternative embodiments, recess 28 and hole 30 may include alternative configurations. For example, both may include a recess resembling recess 28. Alternatively, both of the aligned openings may resemble hole 30. It is preferred that at least one of the openings comprise a circular hole so that the ladder is not unintentionally lifted off of the upper shaft if the tide rises excessively. Utilizing at least one recess facilitates installation somewhat.

The fully assembled safety ladder apparatus 10 pivots about shaft 68, as indicated by double headed arrow 84, FIG. 1, between a retracted condition, shown generally in FIG. 8 and an extended condition, shown in FIG. 9. Most of the time, when apparatus 10 is not in use, ladder 16 remains in the retracted condition shown in FIG. 8. Float 40, or alternatively, the integral buoyant material comprising the ladder, supports the ladder at, near or preferably above the upper surface of water W. As a result, the ladder is held largely, if not entirely, out of the water. Premature deterioration of the ladder is thereby resisted. Barnacles do not collect and, as a result, the ladder is much safer to climb. By the same token, the undesirable buildup of seaweed, algae and other types of marine debris is deterred so that the user is less apt to slip when climbing the ladder.

Safety ladder apparatus 10 is extremely convenient to use when needed and exhibits significantly improved safety characteristics. For example, a person, child or animal that has fallen into water W is able to readily and conveniently access and climb the ladder. Ladder 16 and float 40 are constructed so that a minimal downward force F, FIG. 9, of 2–3 pounds causes the ladder to overcome the buoyancy of the float and pivot downwardly so that lower portion 24 extends into and below the surface of water W. For example, a person who has fallen into the water and is attempting to climb onto seawall 12 simply grabs the lower portion 24 of the floating ladder 16, shown in FIG. 8, and pulls the ladder downwardly as indicated by arrow 90 into the position shown in FIGS. 1 and 9. The upper end 26 of ladder 16 pivots about shaft 68 in the manner indicated by arrow 92. The ladder pivots downwardly until the lower edges 94 of the ladder's side rails engage lower stop shaft 72. This stops the downward pivoting of the ladder and holds the ladder in the angled position shown in FIGS. 1 and 9. The lower end 24 of ladder 16 is submerged in water W and the ladder extends upwardly from the water at an angle of approximately 45° to the surface plane of the water. Shaft 72 prevents the ladder from pivoting more than this amount (i.e. pivoting into a vertical orientation) and thereby positions the steps 32 in the manner shown in FIGS. 1 and 9. Specifically, the plane of each step is angled approximately 45° to the longitudinal axes of the side rails 20 and 22. As a result, when downward pivoting of the ladder is stopped, the steps are automatically positioned so that they are virtually horizontal. The person accessing the ladder is thereby able to conveniently climb the deployed or extended ladder. Little or no arm or upper body strength or agility is needed, as is required in the case of vertical safety ladders. Rather, the user simply steps onto the submerged, horizontally oriented lower steps 32 and climbs the ladder in a manner analogous to a conventional flight of stairs. Climbing is facilitated even further because the user is able to grasp the handrails 36 formed along the upper edges of the side rails of the ladder. As the user reaches the upper end of the ladder, he or she may grasp the support handle 74 as they climb onto the seawall. The handle therefore facilitates ascent of the stairs. The apparatus is especially beneficial for use by small children, the elderly and persons with physical limitations and other people who would otherwise have difficulty climbing a standard vertical mounted ladder.

It should be understood that the apparatus is extremely beneficial not only for rescuing or assisting a person in water W, but also for serving as a convenient means to climb from a vessel onto a seawall or other platform structure. By the same token, the ladder helps to assist swimmers, scuba divers and other persons into a boat or other watercraft after the water activity is completed. Even pets and wild animals that are stranded in the water can easily access and use ladder apparatus 10. When the animal grasps the lower portion 24 of the ladder, its weight alone will typically cause the ladder to pivot downwardly in the manner described so that the steps are oriented for convenient ascent. Of course, a typical animal cannot ascend a conventional vertically mounted ladder. The marine safety ladder of this invention uniquely provides that capability.

After the ladder has been ascended and the weight removed from the ladder, the buoyancy of float 40 and/or ladder 16 causes the ladder to float back to its initial position shown in FIG. 8. As a result, the ladder is positioned in the water for only a very brief time as needed. This enables the ladder to resist deterioration and exhibit a much longer useful life.

It should also be noted that as the tide rises and lowers, the ladder 16 is allowed to pivot about shaft 30. In any event, when the tide drops below a threshold level, the lower edges 94 of the ladder engage lower shaft 72 and further downward pivoting is restricted. As the tide drops, downward pivoting of the ladder typically caused by the weight of the ladder alone. As the tide rises, the float causes the ladder to pivotably return to its horizontally retracted condition, shown in FIG. 8.

A slightly modified marine safety ladder 110 according to this invention is shown in FIG. 9. Therein, mounting bracket 118 includes a clamp portion 149 for snugly engaging seawall cap 114. In particular, a flat upper plate 150 engages the upper surface of the seawall cap. A flat second plate 154 is attached unitarily and depends from plate 150. Plate 154 extends downwardly from plate 150 at an angle of about 90° such that plate 154 flushly engages the front surface of seawall cap 114. An inwardly turned lower horizontal plate portion 158 is unitarily connected to plate portion 154 and extends snugly beneath the bottom lip of the seawall cap. Finally, a depending plate 160, which is unitarily attached to plate portion 158, engages the lower, outer face of the seawall. Clamp portion 149 also includes one or more threaded locking clamps 161, which extend through plate portion 158. Each locking clamp 161 typically includes a lower nut 163 that is turned to selectively tighten or loosen the upper end of locking clamp 161 against the lower lip of seawall cap 114. By tightening the clamps, clamp portion 150 is locked securely onto the seawall cap.

A handrail 174 is attached to and extends upwardly from clamp portion 149 of mounting bracket 118. The handrail is composed of a corrosion-resistant metal similar to that composing the remainder of the mounting bracket. Normally, the lower ends of the handrail are welded or otherwise permanently mounted to upper plate 150 of clamp 149. An L-shaped gusset or reinforcing lip 181 is formed across the upper surface of plate portion 150 and the outer surface of plate portion 154. This component strengthens or reinforces the interconnection between the handrail (and the shafts described below) and the mounting bracket.

An upper pivot shaft 168 and a lower stop component 172, which are analogous to the pivot shaft and stop component in the previously described embodiment, are secured to and extend horizontally outwardly from mounting bracket 118. A pivot bushing or collar 170 is formed proximate the inner end of shaft 168 and an annular collar 173 is similarly formed proximate the outer end of stop member 172. The pivot shaft and stop member are joined by a bar 175 that extends between the distal end of pivot shaft 168 and lower collar 173. Once again, the pivot shaft and stop member are composed of a non-corrosive metal similar or identical to that composing the remainder of the mounting bracket, handrail and reinforcing gusset.

A ladder apparatus 116, which is analogous to the ladder apparatus previously described, is pivotably mounted upon shaft 168, once again in a manner similar to that of the previously described embodiment. Shaft 168 extends through respective slots or openings in the side rails of ladder 116 such that ladder 116 is pivotable about shaft 168 between raised and lowered conditions. Stop member 172 limits downward pivoting of ladder 116 and holds the ladder at a convenient angle (e.g. 45°) relative to the surface of the water W. Steps 132 of ladder 116 are oriented between the side rails of the ladder such that when the ladder is in a lowered condition and engaged against stop member 172, the steps are supported in a substantially horizontal orientation. This enables a person (or animal such as a dog) to conveniently climb the steps of the ladder to the upper surface of the adjoining support platform (e.g. dock, seawall, pier, boat).

The lower end of ladder portion 116 shown in FIG. 9 again is provided with a buoyant float component (not particularly shown in this embodiment but analogous to the float previously described). Alternatively, the ladder may be composed of an integral buoyant material. In either case, the ladder is floatable upon and above water W and is raised and lowered with the water in accordance with the changing tides. Accordingly, until use of the ladder is required, the ladder floats above and is preferably spaced above) the upper surface of the water. It therefore resists corrosion and premature deterioration in a manner analogous to the previously described embodiment. When a predetermined weight (2–3 pounds or more) is applied to the lower steps 132, the ladder pivots downwardly until it engages stop member 172. After the user has completed ascending or descending the ladder and the weight is removed, the ladder floats back to the surface of the water.

The buoyant, pivoting marine safety ladder of the present invention therefore provides a number of useful benefits. It is quickly and conveniently accessed and deployed as needed by either persons or animals. The ladder is much easier to ascend than conventional marine safety ladders because the ladder and its steps are oriented at a convenient 45° angle to the surface of the water. This apparatus also maintains the ladder largely, if not entirely, above the water when the ladder is not in use. This increases the safety and extends the life of the ladder considerably.

Figure 10:
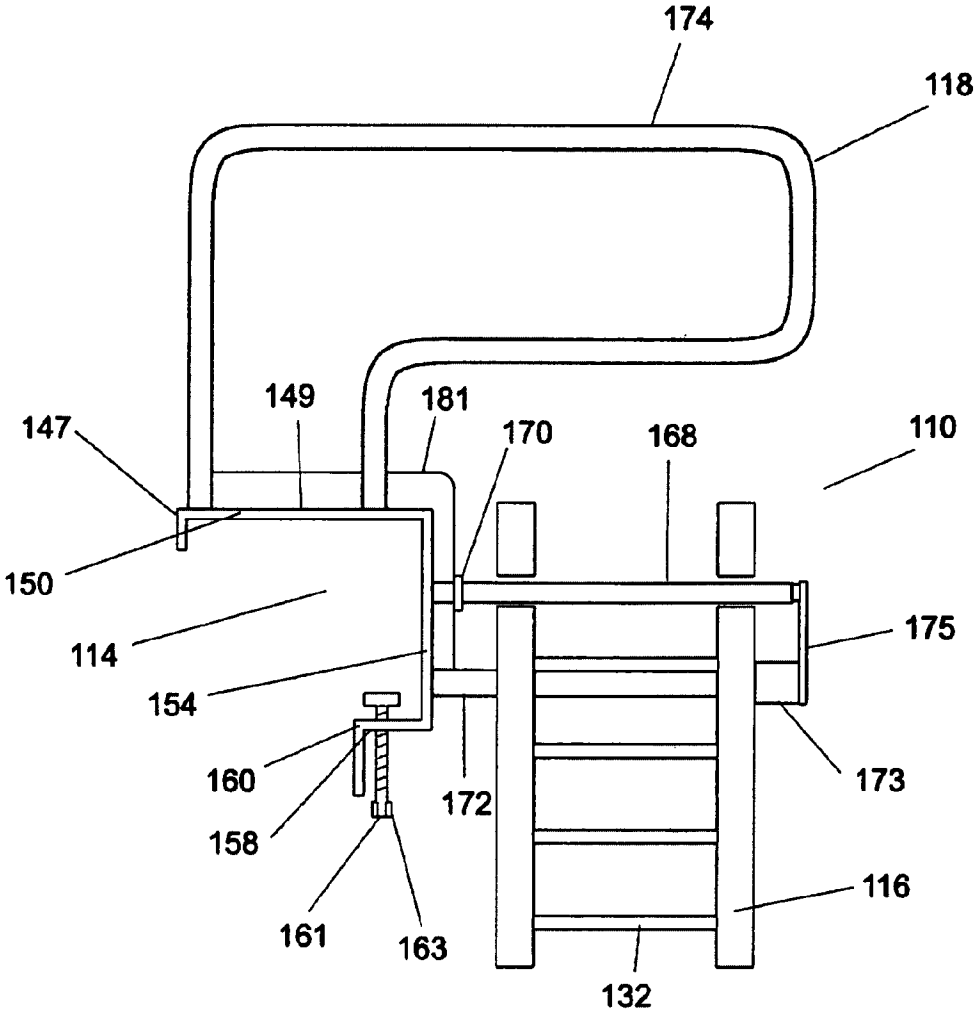
FIG. 10 is an elevational side view of an alternative mounting bracket.
Figure 12:
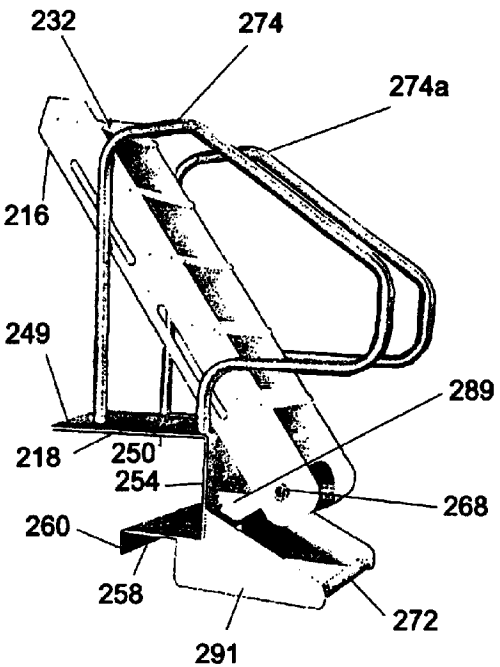
FIGS. 11 and 12 are perspective views of an alternative ladder apparatus according to this invention wherein the ladder is pivoted to and extends perpendicularly from the support platform.
Figure 11:
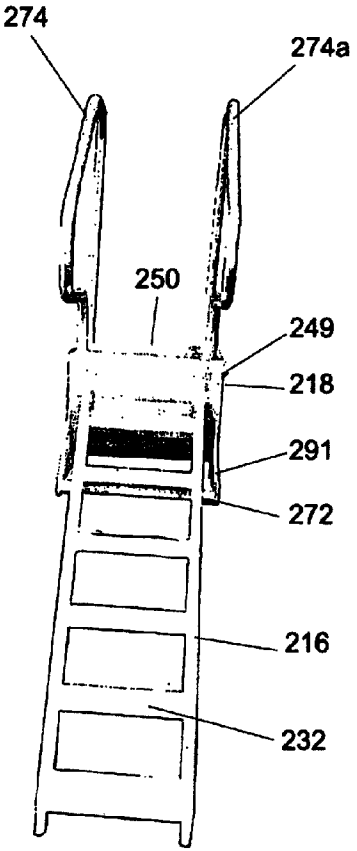

It should also be understood that in alternative embodiments the ladder may be mounted at a right angle relative to that described herein such that the ladder is mounted to pivot about an axis that is parallel to the edge of the seawall or other platform structure, i.e. the lower end of the ladder pivots alternately toward and away from the platform structure. Such an embodiment is depicted in FIGS. 10 and 11. Once again, a mounting bracket 218 composed of a corrosion-resistant metal is mounted to the outer edge of a pier, vessel, seawall, etc. such that the ladder apparatus 216 is supported to extend perpendicularly (or otherwise transversely) from the platform structure. Mounting bracket 218 includes a lower portion 249 which is shaped to conformably or otherwise snugly interengage platform structures such as the lip of a pier, the cap of a seawall, etc. Portion 249 includes a plurality of perpendicularly interconnected plates or pieces 250, 254, 258 and 260, which interengage respective surfaces or components of the seawall, pier, etc. Depending piece 260 may hook around a beam or other supportive portion of a pier. Although not depicted, locking clamps, as in the described previously embodiment, may be utilized with bracket portion 249 such that the bracket may be locked or fastened selectively onto a dock, pier or other platform structure.

A pair of handrail components 274 and 274*a* are welded or otherwise fastened to the upper surface of plate 250. These handrail components are configured conveniently to provide a user of the ladder with stable and reliable support while ascending or descending the lowered ladder (i.e. the ladder in the condition shown in FIG. 10). Handrail components 274 and 274*a* should be spaced apart sufficiently so that persons of average size can pass comfortably between the handrail components.

Mounting bracket 218 also carries upper and lower shaft supporting brackets 289 and 291, respectively. Upper bracket 289 comprises a spaced-apart pair of generally triangular plates, to which are connected respective elongate pivot pins 268. Similarly, lower bracket 291 comprises a spaced-apart pair of triangular plates that support a lower stop component 272, which extends between the plates.

Marine ladder 216 features a construction identical or analogous to the previously described embodiments. Ladder 216 is rotatably or pivotably mounted to pivot shaft 268 such that ladder 216 is alternatable between the lowered condition shown in FIG. 10 and the fully raised condition depicted in FIG. 11. In the lowered condition, the lower edges of the side rails of ladder 216 interengage stop component 272. As a result, the ladder is supported at an angle of 45° (or at some other convenient angle) relative to the water.

Although a float component is not depicted in FIGS. 10 and 11, such a component may be utilized with ladder 216 in a manner analogous to that previously described. As a result, ladder 216 floats above the upper surface of the water and is raised and lowered with the tides. When use of the ladder is required, a predetermined force (e.g. at least approximately 2–3 lbs) is exerted downwardly upon a lower end of the ladder. The ladder submerges beneath the water and pivots downwardly until it engages stop component 272. At this position, the ladder is supported at an angle of about 45° so that it may be conveniently ascended or descended. Once again, the steps 232 of ladder 216 are oriented between the side rails such that the steps are held substantially horizontal when the ladder is engaged with the stop component 272. This allows a user to climb or descend the ladder in a relatively safe and secure manner. Handrail components 274 and 274*a* further facilitate use of the ladder and enhance its safe use. In virtually all other ways, the version in FIGS. 10 and 11 is constructed and operates analogously to the previously described versions. Similar advantages are likewise obtained.

It should be understood that in still other embodiments, alternative types of pivot mechanisms may be used for interconnecting the ladder to the platform structure. Various types of pins, hinges, bearings, bushings and other forms of pivotable interconnection may be utilized. It should also be understood that the stop component may be constructed in a different way and utilize configurations that are different from those shown herein, but which still effectively limit downward pivoting of the ladder and support the ladder so that it may be securely and safely ascended and descended. The stop component may be attached directly to and/or comprise a portion of the pier, dock or other platform structure. Likewise, the pivotable ladder may be connected directly to the platform structure without use of a bracket.

The mounting bracket may be composed of various metals and metal alloys that are typically corrosion-resistant. For example, these materials may include ¼" steel that has been powder coated; ¼" steel that has a galvanized finish; ¼" stainless steel; and ¼" aluminum, which has been powder coated. Typically, the mounting bracket extends about 2 feet outwardly from the platform structure. A ladder mounted generally parallel to the platform typically utilizes approximately 5 fee of space, although this may vary depending upon the number of steps employed. Typically, the ladder will have five to seven steps. Alternative numbers of steps and step sizes may be employed within the scope of the invention.

The ladder is typically composed of a corrosion-resistant, high strength plastic, such as that presently marketed under the brand name Starboard™. The side rails and steps may employ various spacings and dimensions within the scope of this invention. Normally, each step will feature non-skid grooves or other skid-resistant construction. The size of the float may be varied to accommodate various sizes, lengths and weights of ladders.

From the foregoing it may be seen that the apparatus of this invention provides for marine safety ladder apparatus and, more particularly, a buoyant ladder that is mounted pivotably to a seawall, pier or the like for alternating between a retracted condition, wherein the ladder floats on a body of water, and a deployed condition wherein the ladder extends into the water at an angle that permits the steps of the ladder to be conveniently ascended. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

What is claimed is:

1. A marine safety ladder apparatus for use in combination with a platform structure located adjacent to and normally above a body of water, said ladder apparatus comprising:

a support bracket for attaching to the platform structure;

a ladder including a pair of elongate side rails pivotably mounted to said support bracket proximate respective upper ends of said rails and a series of transverse steps extending between and interconnecting said side rails said support bracket carrying a pivot mechanism to which said side rails are pivotably mounted, said ladder being pivotable through the water between raised and lowered conditions and further being buoyant within the water such that the ladder floats on the upper surface of the water when the water is above a threshold level and less than a predetermined external downward force is applied to a lower portion of the ladder;

said lower portion of said ladder pivoting downwardly into the lowered condition in response to at least one of the water level dropping to or below the threshold level and said predetermined external downward force being applied thereto, whereby at least a portion of said ladder is submerged when the water level is above the threshold level and the predetermined external downward force is applied thereto; and a stop component attached to said bracket for limiting downward pivoting movement of said ladder into the lowered condition such that said ladder extends at a non-vertical angle relative to the upper surface of the water wherein said stop component includes an elongate stop member carried by said support bracket and extending generally parallel to said pivot shaft.

2. The apparatus of claim 1 in which said ladder is provided with a buoyancy such that the predetermined external force is at least two pounds.

3. The apparatus of claim 1 in which said steps are oriented between said side rails such that an upper surface of each step is held substantially horizontally when said ladder is in the lowered condition.

4. The apparatus of claim 1 in which said stop component is positioned such that said ladder forms an angle of approximately 45° with the upper surface of the water when said ladder is in the lowered condition.

5. The apparatus of claim 1 in which said ladder forms an angle of approximately 0° with the upper surface of the water when the ladder is in the raised condition.

6. The apparatus of claim 1 in which said support bracket carries a locking mechanism for releasably locking said bracket to the platform structure.

7. The apparatus of claim 1 in which said pivot shaft, said stop member and said side rails are arranged such that said side rails extend at an angle of 45° relative to the surface of the water and interengage said stop member when said ladder is in the lowered condition.

8. The apparatus of claim 1 in which said pivot mechanism supports said ladder such that said ladder is longitudinally extendible generally parallel to the outer edge of the platform.

9. The apparatus of claim 1 in which said pivot mechanism supports said ladder such that said ladder is longitudinally extendible transversely to the outer edge of said platform.

10. The apparatus of claim 1 further including a float element mounted to the lower portion of said ladder to provide said ladder with buoyancy.

11. The apparatus of claim 1 in which said side rails and said steps includes an integrally buoyant material.

12. The apparatus of claim 1 in which said side rails include longitudinal grooves for defining hand rails to assist a person climbing or descending said ladder.

13. The apparatus of claim 1 including a handrail attached to said bracket and extending upwardly therefrom.

14. A marine safety ladder apparatus for use in combination with a platform structure located adjacent to and normally above a body of water, said ladder apparatus comprising:

a support bracket for attaching to the platform structure;

a ladder including a pair of elongate side rails pivotably mounted to said support bracket proximate respective ends of said rails and a series of transverse steps extending between and interconnecting said side rails, said support bracket carrying a pivot mechanism to which said side rails are pivotably mounted, said pivot mechanism including an elongate pivot shaft to which said side rails are mounted, said side rails including aligned slots for interengaging said pivot shaft, and said ladder being pivotable through the water between raised and lowered conditions and further being buoyant within the water such that the ladder floats on the upper surface of the water when the water is above a threshold level and less than a predetermined external downward force is applied to a lower portion of the ladder;

said lower portion of said ladder pivoting downwardly into the lowered condition in response to at least one of the water level dropping to or below the threshold level and said predetermined external downward force being applied thereto, whereby at least a portion of said ladder is submerged when the water level is above the threshold level and the predetermined external force is applied thereto; and a stop component attached to said support bracket for limiting downward pivoting movement of said ladder into the lowered condition such that said ladder extends at a non-vertical angle relative to the upper surface of the water.

15. A marine safety ladder apparatus for use in combination with a platform structure located adjacent to and normally above a body of water, said ladder apparatus comprising:

a support bracket for attaching to the platform structure;

a ladder including a pair of elongate side rails pivotably mounted to said support bracket proximate respective ends of said rails and a series of transverse steps extending between and interconnecting said side rails, said ladder being pivotable through the water between raised and lowered conditions and further being buoyant within the water such that the ladder floats on the upper surface of the water when the water is above a threshold level and less than a predetermined external downward force is applied to a lower portion of the ladder;

said lower portion of said ladder pivoting downwardly into the lowered condition in response to at least one of the water level dropping to or below the threshold level and said predetermined external downward force being applied thereto, whereby at least a portion of said ladder is submerged when the water level is above the threshold level and the predetermined external force is applied thereto; and a stop component attached to said support bracket for limiting downward pivoting movement of said ladder into the lowered condition such that said ladder extends at a non-vertical angle relative to the upper surface of the water, wherein said stop component is intereng-agable by respective lower edges of said side rails to limit lowering of said ladder.

* * * * *